US007419221B2

(12) United States Patent
Fisher et al.

(10) Patent No.: US 7,419,221 B2
(45) Date of Patent: Sep. 2, 2008

(54) THEATRE CHAIR

(75) Inventors: David John Fisher, Wantirna South (AU); Adam William Fisher, Wantirna South (AU)

(73) Assignee: Camatic Pty Ltd., Wantrina South Victoria (AU)

( * ) Notice: Subject to any disclaimer, the term of this patent is extended or adjusted under 35 U.S.C. 154(b) by 632 days.

(21) Appl. No.: 10/220,751

(22) PCT Filed: Mar. 2, 2001

(86) PCT No.: PCT/AU01/00232

§ 371 (c)(1),
(2), (4) Date: Dec. 10, 2003

(87) PCT Pub. No.: WO01/64078

PCT Pub. Date: Sep. 7, 2001

(65) Prior Publication Data

US 2004/0095009 A1 May 20, 2004

(30) Foreign Application Priority Data

Mar. 2, 2000 (AU) ..... PQ5975

(51) Int. Cl.
*A47C 4/02* (2006.01)

(52) U.S. Cl. ..... 297/440.2; 297/440.22

(58) Field of Classification Search ..... 297/440.2, 297/440.22, 219.1, 228.13, 452.18, 452.55
See application file for complete search history.

(56) References Cited

U.S. PATENT DOCUMENTS 1,232,931 A * 7/1917 Kilbum ..... 297/440.22
1,251,976 A * 1/1918 Ledwinka ..... 296/63
3,669,497 A * 6/1972 Massonnet ..... 297/440.22
4,126,354 A * 11/1978 DeLong et al. ..... 297/248
4,169,627 A * 10/1979 Murphy et al. ..... 297/440.22
4,332,419 A * 6/1982 Vogel ..... 297/440.22
5,375,914 A * 12/1994 Donnelly ..... 297/335
6,062,649 A * 5/2000 Nagel et al. ..... 297/452.38
6,135,562 A * 10/2000 Infanti ..... 297/440.2
6,149,240 A * 11/2000 Pietrzak ..... 297/440.22
6,220,661 B1 * 4/2001 Peterson ..... 297/440.11
6,305,750 B1 * 10/2001 Buono et al. ..... 297/440.2

* cited by examiner

*Primary Examiner*—Peter R. Brown
(74) *Attorney, Agent, or Firm*—Drinker Biddle & Reath LLP

(57) ABSTRACT

A theatre chair having a frame to which there is connected at least a seat component and a backrest component, and further including a device on the seat component to co-operate with a seat member and a device on the backrest component to cooperate with a backrest member, so that the seat member and the backrest member can each be readily attached to the appropriate component to be positively affixed thereto; the seat member and backrest member being able to be removed from the appropriate component, as required. The connection between the seat component and the backrest component, and the seat member and backrest member, can be by way of interacting lugs, interacting ribs and a device so that the various parts are held in compression and tension. A device for rapidly replacing the upholstery and a device allowing for the same components to be used for chairs of different widths are also disclosed.

8 Claims, 6 Drawing Sheets

THEATRE CHAIR

Figure 1:
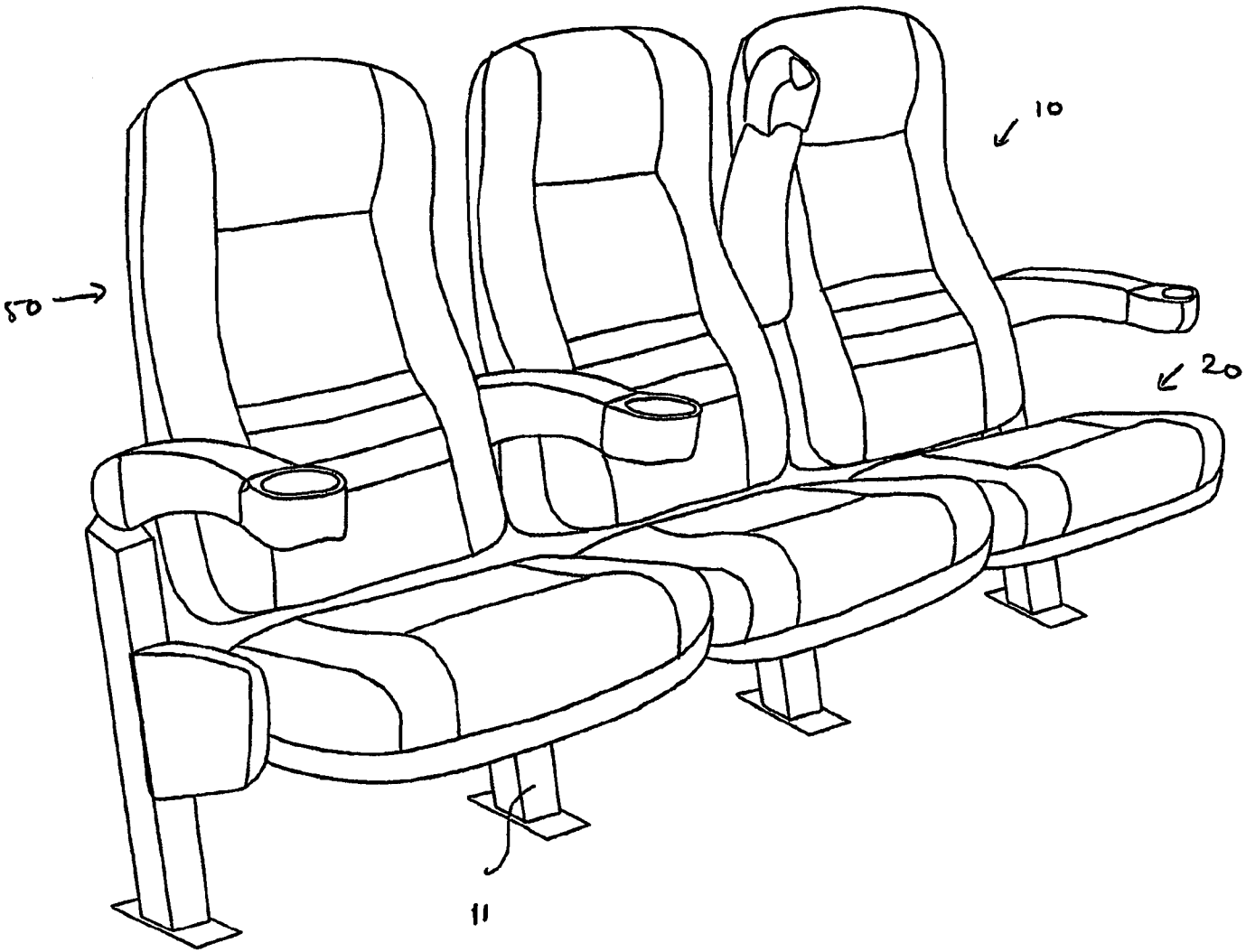

This invention relates to theatre chairs and is generally useful for chairs used in cinemas, auditorium and theatres.

When a cinema (which we shall use as an exemplification) is being built or refurbished when the chairs are located, care must be taken not to damage the upholstery of these chairs or to locate chairs where they can be damaged by other trades still working on the incomplete cinema.

In some applications, it is preferred that some seats, generally the more expensive, are spaced at intervals greater than the others. This has normally meant that to provide seats for different spacing, it has been necessary to provide seats which are different from the remainder of the seats in the theatre.

Further, with theatre chairs generally, it is necessary to refurbish the chairs at intervals, which normally means removing the chairs from the theatre and, say, re-upholstering them and then returning them to the theatre or removing structural components from the chair. Neither operation is very satisfactory.

Further, individual chairs in theatres can be damaged either inadvertently or by vandalism and it is then necessary to re-upholster or repair these chairs on an individual basis. This has led to similar difficulties as described above where a theatre is being refurbished although, to an extent, the problem can be exacerbated as often it is necessary to have a skilled person come to the theatre to remove and replace a seat.

A first object of the present invention is to provide a cinema chair which can initially be located in a cinema in its required position without the upholstered portions thereon so that likelihood of damage during construction is minimised and which, at the same time can readily have the upholstered portions removed and reinstalled, should be it be necessary for refurbishment, either to an individual chair or to the chairs in the theatre generally.

A second object is to provide a seat which can be located at different spacings so that it is not necessary to provide different seats for different spacings.

The invention in its broadest sense includes a theatre chair having a frame which has at least a seat component and a backrest component and, providing means on the frame to cooperate with a seat member and means to co-operate with a backrest member whereby the seat member and backrest member can be readily removed from and replaced on the appropriate component.

In one particular form of the invention we provide complementary clip means whereby the seat member or backrest member can be clipped to its appropriate component in a manner which is removable but which, at the same time, provides a positive connection.

In one particular form of the invention we use a toggle joint which provides a snap over type connection to assist in retaining the components together which joint can be released by the insertion of an appropriate tool.

In a second aspect of the invention, which may be associated with a seat as described above, we provide in the underside of the seat component, on each side thereof, a recess adapted to receive a pivot block, the pivot blocks having a longitudinal aperture into which a pivot member mounted on the seat frame adjacent thereto can pass to permit the seat to pivot about the pivots, characterised in that the pivot blocks can be located at different positions relative to the side of the seat so that the pivot blocks can co-operate with pivots having different spacings, and thus the seat component can be used in seats having different widths.

In order that the invention may be more readily understood and put into practice we shall describe, with reference to the accompanying drawings, in one particular seat made in accordance with the invention.

Figure 2:
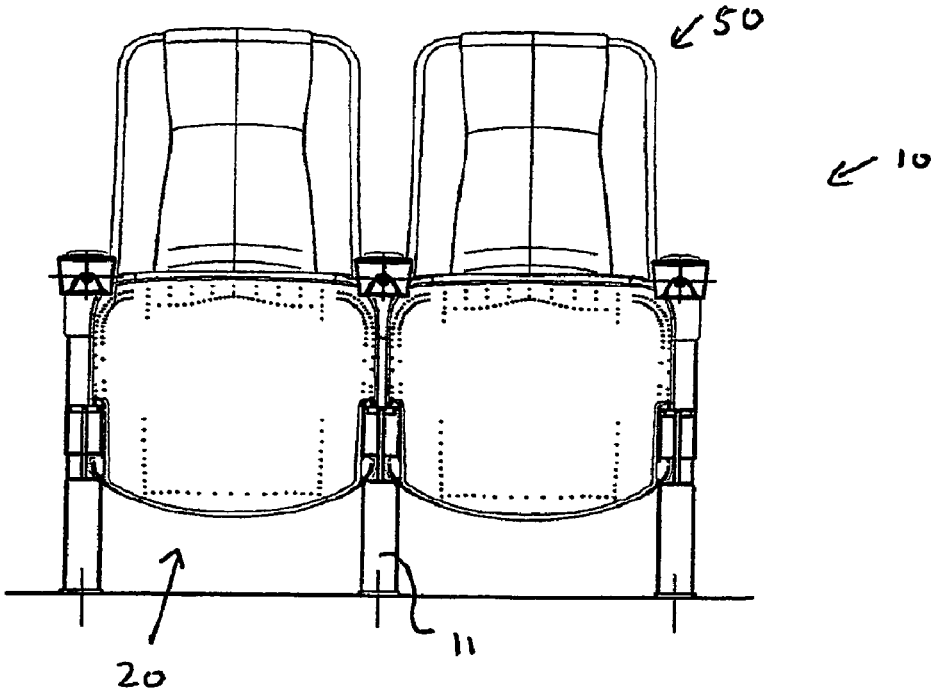
Figure 3:
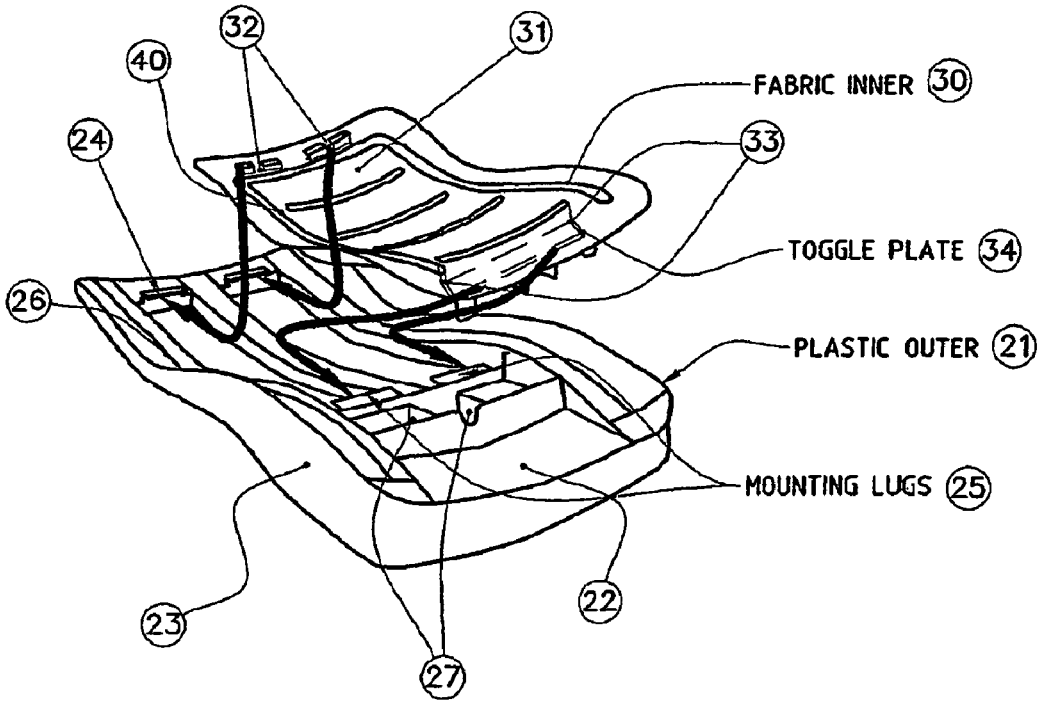
Figure 4:
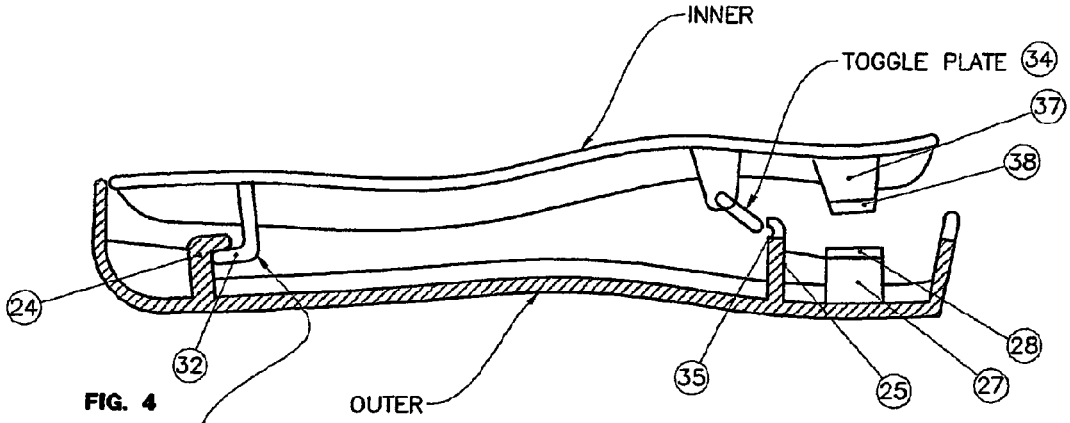
Figure 5:
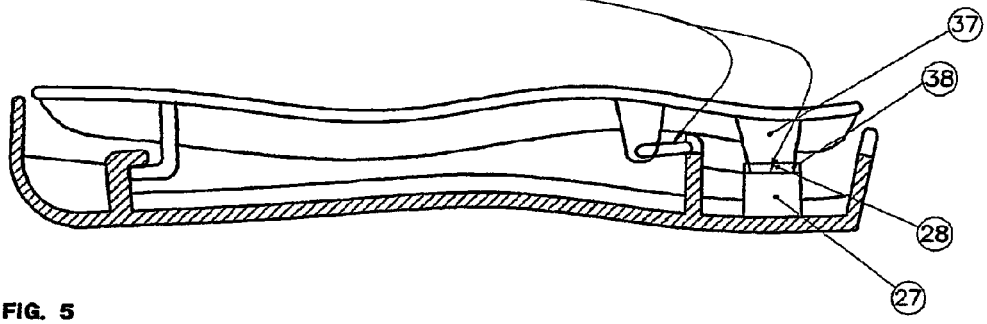
Figure 6:
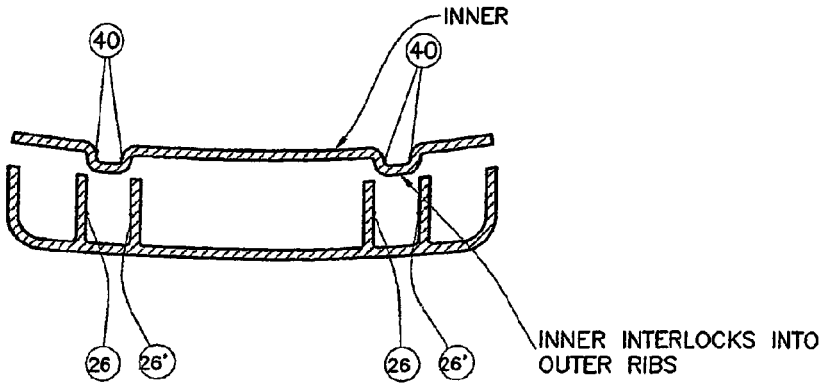
Figure 7:
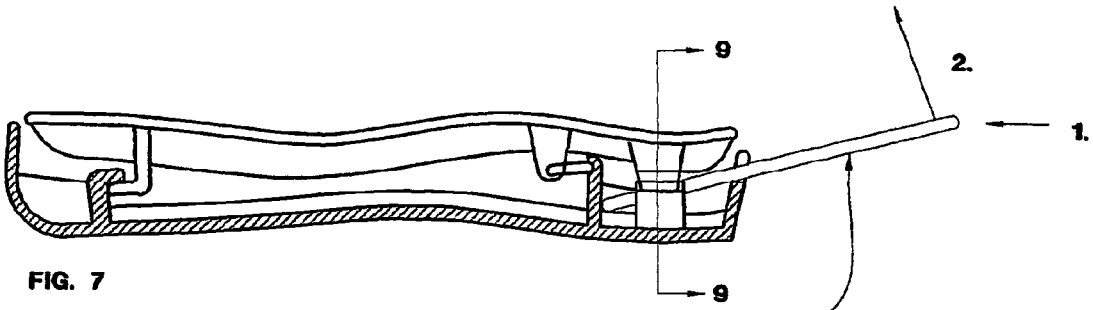
Figure 8:
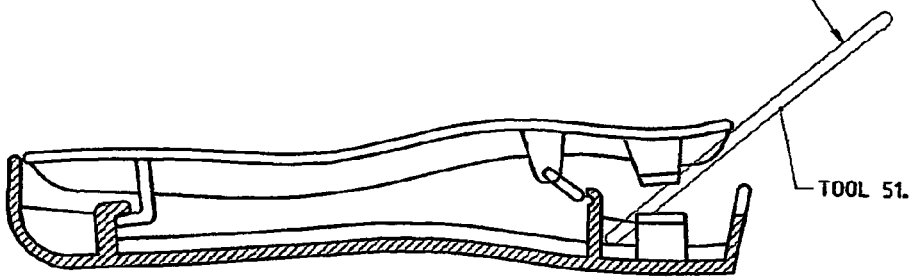
Figure 9:
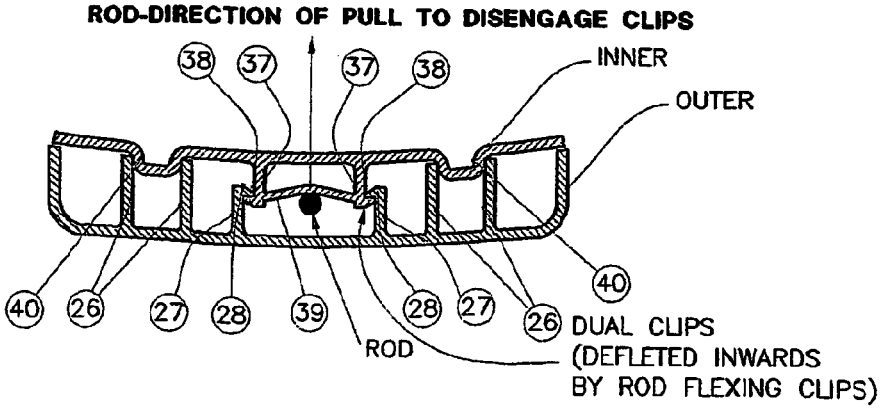

In these drawings:

FIG. 1. Is a perspective view of a seat incorporating the invention;

FIG. 2. Is an elevation of the seat;

FIG. 3. Is a view of seat components separated;

FIG. 4. Is a side view of the components of FIG. 3 showing the components before inter-engagement;

FIG. 5. Is a view similar to that of FIG. 4 showing the components inter-engaged;

FIG. 6. Is a transverse section showing the components when interlocked;

FIG. 7. Is a side sectional view showing the first stage of disengagement;

FIG. 8. Shows disengagement continuing;

FIG. 9. Shows and end view of the situation of FIG. 7

Figure 10:
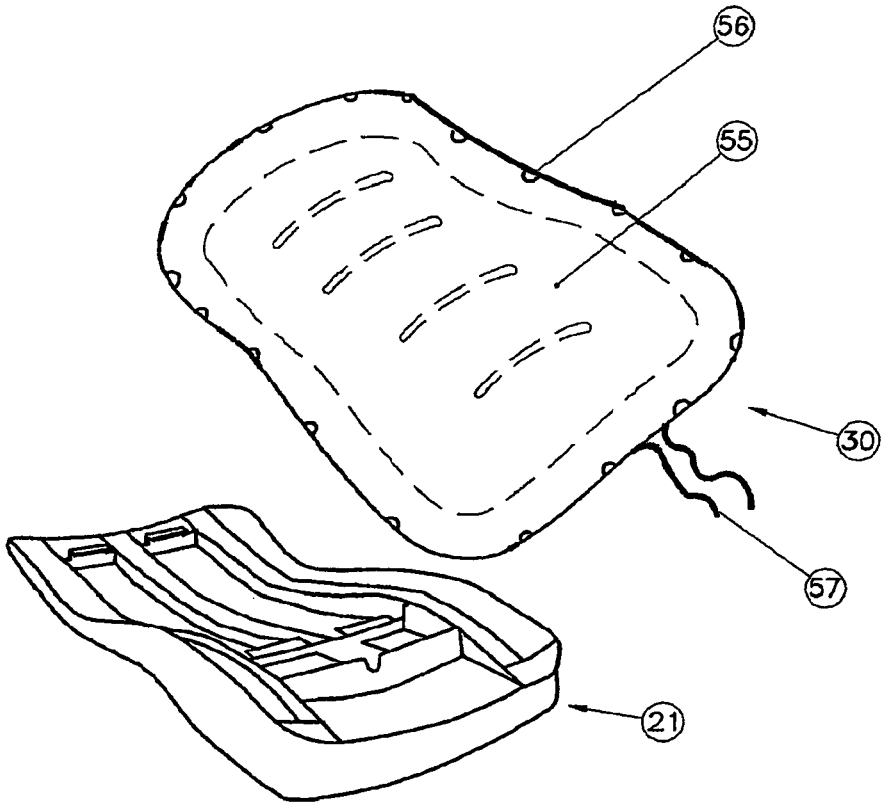
Figure 11:
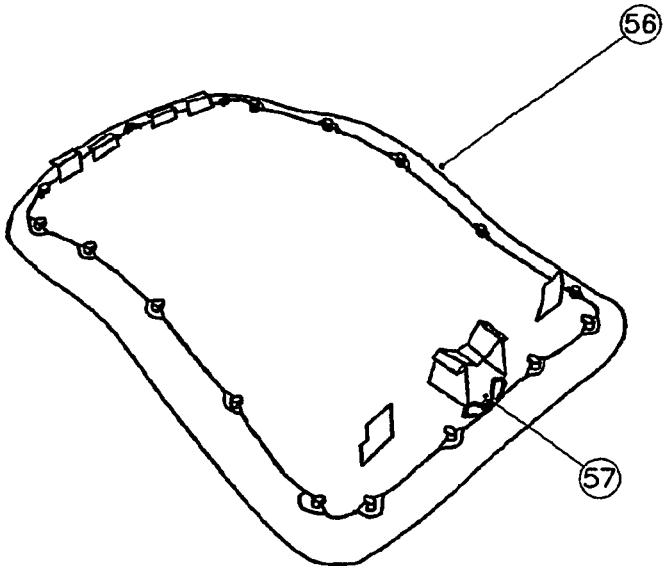
Figure 12:
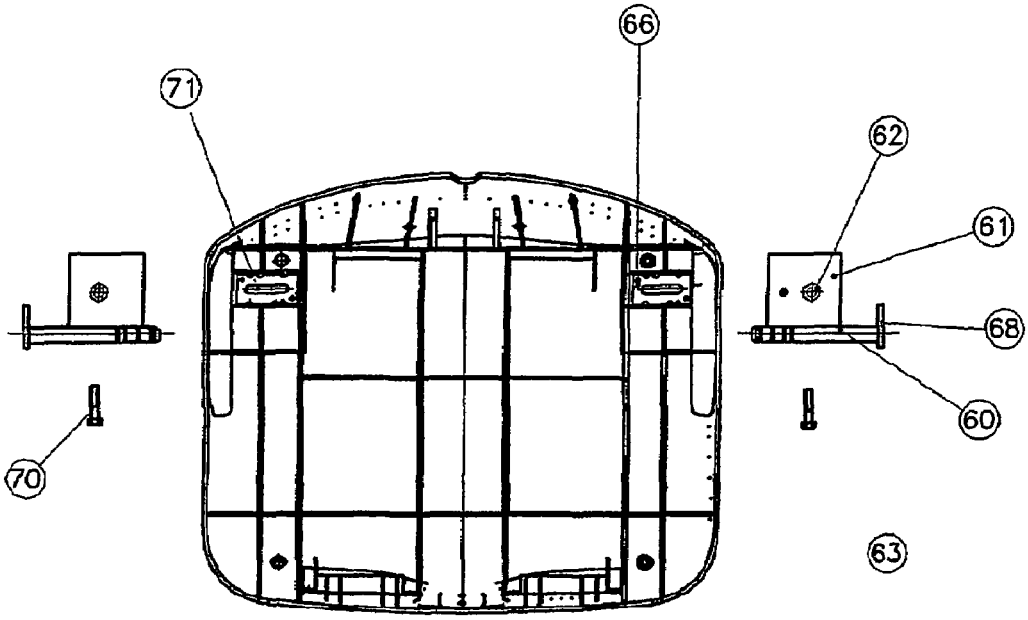

FIG. 10. Shows the method of replacing an upholstery envelope;

FIG. 11. Shows an underneath view of the envelope tightened;

FIG. 12. Shows the underside of the seat with, exploded therefrom the mounting pivot whereby the seat can be used for various widths; and FIG. 13. Shows a side view of the arrangement of FIG. 10.

The chair 10 can have any general formation and has a frame 11 which is adapted to be permanently or semi-permanently connected to the floor of the auditorium and this has both a seat component 20 and a backrest component 50 connected thereto or partially integral therewith. FIGS. 1 and 2 show that the seat can look very similar to conventional theatre seats.

The seat component may be adapted to be fixed relative to some part of the frame or may be rotatable thereabout to enable the seat to rise, as it is well known in the art.

The components may preferably be of an engineering grade plastics material and be formed by injection moulding or could be formed in any other way.

Functionally, the seat component and the backrest component may be similar or identical although, in exterior shape they may differ substantially to enable them to operate in the required manner. In this following, we shall refer only to the seat component but it is to be understood that, functionally, the two components can be identical.

In a preferred form of the invention, the seat component, has two sub-assemblies, a base 21 and a seat member 30.

The base 21 has a floor 22 which lies generally in a horizontal plane when the seat is in its use position and the floor 22 has an upwardly directed peripheral skirt 23 around it's sides.

Formed on the floor 22 there are a number of lugs 25,25', 26,26' and in a preferred form there are four such lugs, each having an upwardly and an inwardly directed portion, the lugs being at a spacing close to each side both near the front and the rear of the base.

The base may also have two pairs of ribs 26,26', one pair running along each side between the lugs, the ribs extending somewhat upwardly, but normally not to the height of the peripheral skirt 23.

Also, in the base rearwardly of the rear lugs there may be a pair of clip members 27 which may be spaced either side of the central axis of the seat, extend upwardly therefrom and have an inwardly directed shoulder 28 the operation of which will be described hereinafter.

The seat member 30, which is upholstered but which, for clarity is shown in the figures as un-upholstered, has a plate or base 31 , which again may be of a plastics material and which has an external peripheral shape basically corresponding to the floor 22 of the base and is adapted to be received within the skirt of the base.

The Padding and upholstery 55 as shown in FIG. 10 is placed on top of the plate and may be effected in a conventional manner.

However, as will be described, by the use of the present invention, we can use what is effectively a removeable cover 56 rather than permanent upholstery.

This is done by forming the outer cover with a draw string 57 or the like and the seat member 30 is provided with the padding and a cover fitted thereto (shown generally at 55). The final surface fabric can then be located over the seat member as an envelope 56 and have a skirt which has a peripheral sleeve through which a cord 57 passes. This skirt extends below the seat member and by tightening the cord the fabric can be caused to closely cover the top and side of the seat member. When the seat member is fitted to the base, as described herein, the skirt is between the base and the plate, is not visible, and cannot be readily removed by an occupant of the seat. If, however, the cover is damaged or dirtied, it is only necessary for the operator to remove the seat (or back) member, remove the cover and replace it with another cover and replace the member. This, as will be described, is a very simple operation and could readily be done by a cleaner who finds a damaged or dirtied cover. This enables the appearance of the seats to be maintained with little expense. Of course, if there is substantial damage, it would be necessary to replace the component concerned.

On the plate 31, and directed downwardly near the forward end thereof, there are a pair of lugs 32 which have both a downwardly and an outwardly directed portion and are adapted to be received under the forwardly directed portions of lugs 24 of the base previously described.

Towards the rear of the plate there are a pair of downwardly extending members 33 which act to receive pivots for a toggle plate 34 which extends transversely across portion of the plate. The width of the plate is sufficient to effectively extend between the rear lugs 25 on the seat base 21 over at least most of their length.

The pivot 35 for the toggle plate 34 is adjacent one side thereof and the plate can be formed to extend generally rearwardly relative to the mounting lugs 33.

Rearwardly again of this, there is a clip member 36 which can have a pair of arms 37 each of which have an outwardly directed shoulder 38, the arrangement being such that the arms are adapted by deformation to pass between the two arms at the rear of seat component so that the shoulders on the lugs of the seat base and on the plate of the seat is member can be fictionally engaged and locked.

The two arms 37 are connected by a web 39 of material, the operation of which will be described hereinafter.

The plate 31 also has a pair of downwardly directed ribs 40 located between the lugs, the ribs being adapted to enter the spaces between the ribs 26,26' on the base to restrain the plate from lateral movement relative to the base.

In use, the chair can be located in its required position in the auditorium with the frame in position. The base 21 and the corresponding component of the backrest can also be located at this time.

At this stage, there was little that can be readily damaged by, say, other tradesmen still working on the auditorium and, should there be damage, it is relatively inexpensive and easy to replace the component.

When it is required to complete the seat by the location of the plate, which is upholstered part of the seat member into general alignment with the base 22, and to bring the lugs 32 at the forward end of the plate to a position beneath the inwardly direct portions of the lugs 24,24' on the base. This is shown in FIG. 4.

At this time, the plate can start to be rotated downwardly about these lugs. As the rotation occurs, the downwardly directed ribs 40 on the plate commence to enter the spaces between the ribs 26 on the base, thus locating the plate laterally relative to the base. As the plate is brought further downwardly, the rearward end of the toggle plate 34 can pass beneath the lugs 25 at the rear of the base.

Further downward movement causes the toggle plate 34 to commence to rotate about its pivot and, the clip portions 36 of the plate commence to engage, by deformation of the arms thereof, the clips 27 of the base. Downward movement is continued and the toggle plate snaps to a position, illustrated in FIG. 5, where it is rearwardly and upwardly directed and the shoulders 38 on the clip components 37 of the plate engage with the shoulders 28 of the clip components 27 of the base.

At this time, the two assemblies are fully interconnected one relative to the other by the interrelationship of the lugs at the forward parts of the members, the inter-engagement of the ribs on the underside of the plate with the upstanding ribs of the base, the locking of the toggle plate beneath the lugs with which it is associated and the clipping together of the clip components.

The toggle plate is preferably formed to that it causes the plate to be placed in compression and the base in tension and aids in ensuring that there is no unconstrained relative movement between the component.

At the same time, because of the form of the inter-engagement between the two members, it is not simple, prima facie, to remove the plate from the base and thus, destructive vandalism would be minimised or obviated.

The same operation is followed for the backrest.

When, however, it is required to dissemble the seat this is basically a simple operation given a required tool and the knowledge of how to do this.

The tool 51 can be a metal rod or such an article as a screw driver and can be placed through a slot in the rear of the assembly so that it lies beneath the web 39 connecting the two clip portions 37 downwardly extending from the underside of the seat member and, can abut the rear of one of the lugs 25 which has received the toggle plate.

If this metal member is then moved upwardly, it can abut the underside of the web 39 which connects the two downwardly directed members 37 and this causes them to move inwardly until the shoulders on the lugs in the component and those of the downwardly extending members on the seat member disengage and the seat member can commence to move upwardly.

The same movement causes the toggle plate to snap over and become released and ultimately the plate 31 can then be removed simply by moving it rearwardly to disengage the lugs 24 near the front of the base and the plate is then free.

To replace the plate or to return the original seat member to the chair, it is only necessary to reverse the initial operation, that is, engage the lugs 32 on the plate with the lugs 24 on the base, and cause the plate to rotate which causes the toggle plate 34 to be actuated and the clip 28,37 to engage. It will be seen that this is a very simple action and can be done by any person with a minimum of training.

If required, the toggle arrangement may include a resilient member which can be located beneath a relatively flat spring member restrained against movement at one end, the spring being moveable to cause compression of the resilient member and to cause operation of the toggle member the resilient member being adapted to ensure that the spring be normally maintained in the required position.

Whilst herein we have described a chair which meets the desiderata that it's upholstery is protected from damage prior to final completion of the auditorium and can be removed and replaced at any time in a matter of seconds, we still provide a chair which is sturdy, the components are held against relative movements so there is no sensation of the seat or backrest being two components, as far as the user is concerned.

The toggle plate can engage in a horizontal slot in the lugs on the seat component rather than under a return, if this is required.

The seat of the present invention, or indeed other forms of theatre seats may be adapted to be used with seats of different widths.

Some cinemas are designed to have seats at greater or lesser spacing and in some, it is required to provide different seats having different spacings. This could be the case where seats which are sold at a more expensive price may be at a wider spacing than those at cheaper prices. Not unusually, the spacings required vary between 22 and 24 inches. It is most inconvenient for a manufacturer or a theatre operator to have to hold components of different sizes for different parts of a particular theatre.

Figure 13:
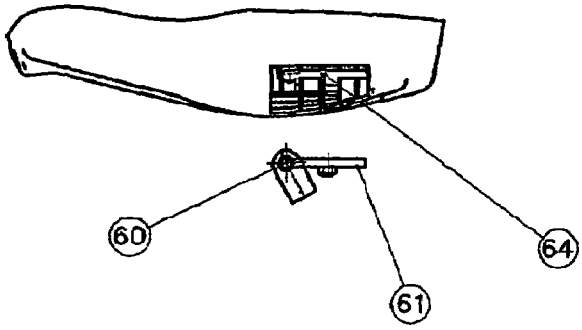

As shown in FIGS. 12 and 13, in the seat of the invention, we provide on the underside of the base 22 an arrangement where the pivot shafts 60 of the seat can be located at various spacings in the seat. We provide, attached to the pivot shaft a flat plate 61 which has an aperture 62 therethrough which has on its underside, a cone-nut. In the side of the base a slot 64 which can receive the shaft 60 and plate 61.

In the base we provide a recess which is adapted to have a tension plate 66 located therein, the slot preferably having undercuts or the like so that the plate 66 is retained once it is fitted.

When the base is to be connected to the frame, the shaft members 60 and plates 62 are located in the slot 64 so that the outer end of the pivot shaft extends from the base by an amount sufficient to permit it to be connected to the pivot journal. A stud 70 is then passed through the elongated slot 71 in the plate 66 and the aperture 62 in the plate 61 and threaded onto the cone nut so that the shaft assembly is fixed relative to the base.

In this way, it is possible to use the same seat component (and backrest component) for is seats on which the arm-rests are at varying distances to give an impression of a more comfortable or economy seat, depending on the type required. It would be possible to provide better upholstery on the seat components which are at greater spacing.

Whilst the illustrated for shows only a single pivot, which would be used with a weighted seat, more complex arrangements could be provided if required.

If the seat is to be moveable, then stop members can be provided to limit the movement of the seat rearwardly, and a member on the frame can be contacted by an extension 68 on the end of the pivot shaft so that it does not rest against the back member, and there may also be buffer means to control the rate of rearward movement. Such arrangements are generally well known in the art.

Also whilst we have described one particular method of construction, it will be understood that any person seeing this particular method could well understand how to make variations in this without departing from the spirit and scope of the invention.

We claim:

1. A theatre chair comprised of:

a frame;

a seat component, having a base member and a seat member, and a backrest component, having a base member and a back member, the seat and backrest components each connected to said frame;

complementary clip means on the seat component base member to cooperate with a the seat member and complementary clip means on the backrest component base member to co-operate with the backrest member each of said complementary clip means comprised of spaced arms having shoulders thereon and a flexible web therebetween, said shoulders being capable of being received by complementary shoulders on a second set of arms on one of the seat member and the backrest member whereby the seat member and backrest member can each be clipped to the appropriate component base member and the web is capable of being deformed so as to cause the arms on the base member to move together thereby releasing the shoulders of the arms from the shoulders of one of the seat and back members.

2. The theatre chair of claim 1 wherein means are provide to permit access to the web by a tool which can be used as a lever to effect the deformation of the web.

3. The theatre chair of claim 1 wherein there are complementary lugs on at least one of the seat and back member and its appropriate component whereby the two can be initially located one relative to the other before the clipping is effected.

4. The theatre chair of claim 1 wherein there are complementary ribs on the two parts which come into engagement during the clipping operation to provide lateral stability of the parts.

5. The theatre chair of claim 1 wherein there is a toggle joint which provides a snap over type connection effective when the seat component and the backrest component are clipped to cause one of the seat and backrest components to be in tension and the other component to be in compression to retain the components together.

6. The theatre chair in claim 1 wherein the seat members and the backrest members are upholstered and in order to effect any repair or replacement of the upholstery, it is only necessary to remove each one of the seat backrest members from the appropriate component.

7. The theatre chair of claim 6 wherein the upholstery includes an outer cover which can fit over the upholstered surface and is connected therebeneath, the arrangement being such that the cover portion which extends therebeneath is located between the component and the member when they are assembled.

8. The theatre chair of claim 7 wherein the outer cover has a drawstring about its periphery to effectively locate and hold the cover over the member.

* * * * *